US011828287B2

(12) United States Patent
Metz et al.

(10) Patent No.: US 11,828,287 B2
(45) Date of Patent: Nov. 28, 2023

(54) SCREW SPINDLE PUMP

(71) Applicant: LEISTRITZ PUMPEN GMBH, Nuremberg (DE)

(72) Inventors: Jürgen Metz, Feucht (DE); Kristin Lissek, Fürth (DE); Florian Popp, Nuremberg (DE)

(73) Assignee: LEISTRITZ PUMPEN GMBH, Nuremberg (DE)

( * ) Notice: Subject to any disclaimer, the term of this patent is extended or adjusted under 35 U.S.C. 154(b) by 0 days.

(21) Appl. No.: 18/078,291

(22) Filed: Dec. 9, 2022

(65) Prior Publication Data

US 2023/0184246 A1 Jun. 15, 2023

(30) Foreign Application Priority Data

Dec. 14, 2021 (DE) ..... 10 2021 133 099.8

(51) Int. Cl.
*F04C 2/16* (2006.01)
*F04C 2/12* (2006.01)

(52) U.S. Cl.
CPC ..... *F04C 2/16* (2013.01); *F04C 2/123* (2013.01)

(58) Field of Classification Search
CPC ..... F04C 2/16; F04C 11/008; F04C 15/0073; F04C 15/0061; F04C 2/165; F04C 2/082;
(Continued)

(56) References Cited

U.S. PATENT DOCUMENTS 2,466,888 A * 4/1949 Garraway ..... F04C 2/16 366/85
4,028,025 A * 6/1977 Lonnebring ..... F01C 21/02 277/377
(Continued)

FOREIGN PATENT DOCUMENTS

DE 4308755 A1 * 9/1994 ..... F04C 15/0061
DE 4308755 A1 9/1994
(Continued)

OTHER PUBLICATIONS

German Office Action dated Aug. 30, 2022, 9 Pages.
(Continued)

*Primary Examiner* — Anthony Ayala Delgado
(74) *Attorney, Agent, or Firm* — LUCAS & MERCANTI, LLP; Klaus P. Stoffel

(57) ABSTRACT

A screw spindle pump, including a spindle housing, in which a drive spindle and a running spindle meshing therewith are received in spindle bores. The drive spindle has a cylindrical spindle core and at least two circumferential spindle profiles, and, on an end face, in a depression axially delimited by a planar bottom surface and in which the two profile valleys open out between the two spindle profiles offset by 180°, there is a disk-shaped coupling element, which has an insertion receptacle for a drive shaft of a drive motor and which is coupled to the drive spindle for conjoint rotation therewith via a form-fitting engagement with axially protruding projections that laterally delimit the depression and engage in lateral receptacles of the coupling element. The bottom surface is delimited by the spindle core in the region of the openings of the two profile valleys, and the coupling element has a rounded configuration, corresponding to the shape of the spindle core, in the element regions that adjoin the regions of the opening. The diameter of the coupling
(Continued)

element, in the region of the rounded element regions, is no greater than the diameter of the spindle core.

12 Claims, 4 Drawing Sheets

(58) Field of Classification Search
CPC ..... F04C 2240/805; F04C 2240/30; F01C 21/108
See application file for complete search history.

(56) References Cited

U.S. PATENT DOCUMENTS

| | | | | |
|---|---|---|---|---|
| 4,308,755 | A * | 1/1982 | Millar | G01F 1/115 73/861.79 |
| 4,674,338 | A * | 6/1987 | Carpenter | G01F 1/115 73/198 |
| 4,848,164 | A * | 7/1989 | Quarve | G01F 15/068 73/253 |
| 10,975,864 | B2 * | 4/2021 | Trossmann | F04C 2/16 |
| 11,339,781 | B2 * | 5/2022 | Deichmann | F04C 2/16 |
| 11,371,501 | B2 * | 6/2022 | Metz | F04C 11/008 |
| 11,486,392 | B2 * | 11/2022 | Richter | F04C 15/0023 |
| 2011/0268598 | A1 * | 11/2011 | Paval | F04C 15/0038 418/83 |
| 2016/0222964 | A1 | 8/2016 | Metz | |
| 2023/0074465 | A1 * | 3/2023 | Grünewald | F41A 9/11 |

FOREIGN PATENT DOCUMENTS

| | | | | |
|---|---|---|---|---|
| DE | 102015101443 | B3 | 5/2016 | |
| DE | 102019103470 | A1 * | 8/2020 | F04C 15/0096 |
| DE | 102020108038 | A1 | 9/2021 | |
| EP | 3832137 | A1 | 6/2021 | |
| WO | 2014138519 | A1 | 9/2014 | |
| WO | WO-2014138519 | A1 * | 9/2014 | F04C 15/0073 |
| WO | WO-2021190975 | A1 * | 9/2021 | |

OTHER PUBLICATIONS

European Patent Office issued an European Search Report dated Apr. 25, 2023 regarding parallel European Patent Application No. 22209989.7, 9 Pages.

* cited by examiner

SCREW SPINDLE PUMP

CROSS-REFERENCE TO RELATED APPLICATIONS

The present application claims priority of DE 10 2021 133 099.8, filed Dec. 14, 2021, the priority of this application is hereby claimed, and this application is incorporated herein by reference.

BACKGROUND OF THE INVENTION

The invention relates to a screw spindle pump, comprising a spindle housing, in which a drive spindle and at least one running spindle, which meshes therewith, are received in spindle bores.

Such a screw spindle pump serves to deliver a fluid, for example fuel or a supply or cooling liquid or the like. The delivery is performed by at least two spindles that mesh with one another, specifically a drive spindle coupled to a drive motor and a running spindle, these spindles being received in a spine housing. To that end, the spindle housing has intersecting spindle bores corresponding to the number of spindles. Usually, the spindle housing is received in a pump housing or outer housing, via which the inflow and outflow of the fluid to be delivered takes place.

The functional principle is based on the drive spindle and running spindle meshing with one another and a delivery volume being axially displaced owing to the rotation of the spindles. To that end, the drive spindle has a cylindrical spindle core and usually two spindle profiles around the circumference of the spindle core. Two profile valleys are formed around the circumference of these spindle profiles and corresponding spindle profiles of the running spindle engage in said profile valleys. Apart from such a two-spindle configuration, it is also conceivable to design the screw spindle with three spindles, that is to say in that case two running spindles are provided, which are offset by 180° next to the central drive spindle and mesh with the latter.

As described, the drive spindle is to be coupled to a drive motor, since the drive spindle is actively rotated, whereas the one or the two running spindles are only entrained. In order to couple the drive spindle to the drive motor or its drive shaft, at the end face of the drive spindle there is arranged a coupling element which, by way of a corresponding form-fitting geometry, is connected to the drive spindle for conjoint rotation therewith. This form-fitting geometry provides at least one rotationally conjoint connection in one direction of rotation. Depending on the design, it is also possible to provide a rotationally conjoint connection in the other direction of rotation, with the result that it is possible to change the drive direction and thus also the direction of rotation of the spindles.

Such a screw spindle pump is known, for example, from DE 43 08 755 A1. That document describes a claw coupling which couples the drive shaft of the motor to the drive spindle. Two intersecting grooves are ground in at an axial end of the drive spindle, as a result of which two oppositely situated, cross-sectionally triangular claws are formed. The disk-shaped coupling element has a circular cross section and is provided with two likewise triangular recesses, in which the triangular claws of the drive spindle engage. In the middle of the coupling element there is provided a slot in which the end portion of the motor-side drive shaft engages.

DE 10 2015 101 443 A1 discloses a screw spindle pump in which the spindle end at which the coupling element is to be arranged has a flat configuration over its entire surface area. The spindle profiles also end at this end face. Bearing surfaces that, as seen radially, are at right angles to one another are formed at two oppositely situated positions by material removal. The coupling element has a corresponding three-dimensional receiving and engagement geometry which is formed such that axial engagement portions are provided, which engage in the two opening-out profile valleys, as it were, and bear against the bearing surfaces formed in the region thereof, with the result that, as seen in the circumferential direction, the coupling element bears flatly against the drive spindle, this bearing effecting a rotationally conjoint connection, while at the same time the coupling element fits axially on the planar end face.

Although couplings of this type, which are often also referred to as claw couplings, have proven successful in principle, there is a need for a screw spindle pump which is improved in terms of the coupling.

SUMMARY OF THE INVENTION

The invention is therefore based on the problem of specifying a screw spindle pump with an improved coupling device.

To solve this problem, what is provided according to the invention is a screw spindle pump, comprising a spindle housing, in which a drive spindle and at least one running spindle meshing therewith are received in spindle bores, wherein the drive spindle has a cylindrical core and at least two spindle profiles around the circumference of the spindle core, and, on an end face of the drive spindle, in a depression which is axially delimited by a planar bottom surface and in which the two profile valleys open out between the two spindle profiles in a manner offset by 180°, there is arranged a disk-shaped coupling element, which has an insertion receptacle for a drive shaft of a drive motor and which is coupled to the drive spindle for conjoint rotation therewith in at least one direction of rotation of the drive spindle via a form-fitting engagement with axially protruding projections that laterally delimit the depression and engage in lateral receptacles of the coupling element, wherein the bottom surface is delimited by the spindle core in the region of the openings of the two profile valleys, and the coupling element has a rounded configuration, corresponding to the shape of the spindle core, in the element regions that adjoin the regions of the opening, wherein the diameter of the coupling element, in the region of the rounded element portions, corresponds at most to the diameter of the spindle core or is smaller than the diameter of the spindle core.

The screw spindle pump according to the invention has a flow-optimized coupling or connection between the drive spindle and the coupling element. In particular, the geometry of the coupling element is selected here such that the coupling element, if anything, only slightly reduces the delivery cross section of the respective profile valley where it opens out on the spindle end face, with the result that the free delivery cross section is nearly not adversely affected at all by the coupling element and accordingly the flow, as seen in an axial direction, is not appreciably adversely affected thereby, this leading to an improvement in the delivery rate.

In order to realize this, a specifically formed coupling element is provided, which has a disk-shaped configuration and two laterally open receptacles in which a respective projection protruding axially from the end face of the drive spindle engages. This form-fitting engagement enables a rotationally conjoint connection in one direction of rotation, preferably of course in both directions of rotation. These axially protruding projections define a depression on the spindle end face, which depression has a planar bottom surface, wherein the coupling element is inserted in precisely this depression. In this respect, the bottom surface of the depression is formed, inter alia, by the spindle core of the drive spindle, since, as described, the two profile valleys open out on this end face. Accordingly, rounded borders formed by the spindle core are provided opposite one another. The coupling element is formed in such a way that it likewise has a rounded configuration in the element regions that adjoin the opening of the profile valleys, that is to say corresponds to the shape of the spindle core, wherein the diameter of the coupling element in the region of these likewise oppositely situated and rounded element portions corresponds at most to the diameter of the spindle core or is smaller than the diameter of the spindle core. This means that, owing to the design of its diameter in relation to the spindle core diameter in the region of these element portions, the coupling element does not protrude into the free flow cross section of the respective opening-out profile valley, with the result that this imperatively does not reduce the flow cross section and thus does not obstruct the flow. By contrast with the screw spindle pumps known from the prior art, in which the coupling elements, owing to their dimensioning or geometry, protrude radially far into the free flow cross section and accordingly greatly reduce it, the coupling element of the screw spindle pump according to the invention no longer constitutes an appreciable obstacle to the flow. The fluid delivered can accordingly flow axially past the coupling element virtually unobstructed, this having an extremely advantageous effect on the pump operation.

In a refinement of the invention, it may be provided that the coupling element has a cylindrical base portion from which four element projections protrude to the side, wherein two adjacent element projections delimit a lateral receptacle. These element projections serve merely to define or delimit the form-fitting geometry, that is to say the receptacles, in which receptacles the axial, spindle-side projections engage. They consequently perform merely a drive function, since they effect the rotationally conjoint coupling in the circumferential direction. It is therefore possible also to design these element projections in a flow-optimized and narrow manner, with the result that they also do not appreciably reduce the flow cross section. In this respect, the end face of the drive spindle may be machined by two cross-grinding means such that, at the protruding projections that laterally delimit the depression and as described axially continue the two spindle profiles, there are provided corresponding, defined engagement geometries in the receptacles designed correspondingly with the same shape. In this way, the planar bottom surface of the depression, in addition to the surface portion formed by the spindle core, is laterally somewhat enlarged, wherein in this region, as viewed axially, the element projections cover these widened regions.

It is expedient when the receptacles extend into the base portion on the coupling element. On the base portion, there is provided the insertion receptacle for the motor-side drive spindle, which for example is configured as a rectangular insertion receptacle which is elongate in cross section. Since ultimately the coupling element only has the task of effecting, on the one hand, the rotationally conjoint connection to the motor-side drive shaft by way of engaging in the insertion receptacle and, on the other hand, the rotationally conjoint connection of the coupling element to the drive spindle, it is accordingly possible for each receptacle to extend relatively far into the cylindrical base regions, this in turn leading to the driver-like element projections protruding from the base region being able to have correspondingly shorter dimensions.

The element projections themselves are expediently triangular and taper toward their free end, and thus overall are very narrow and also have a relatively short configuration.

In this respect, the thickness of each element projection may decrease toward its free end. The coupling element is consequently reduced as far as possible in terms of material.

The insertion receptacle itself preferably has a square shape. In this respect, the insertion receptacle may have a rectangular, that is to say somewhat elongate shape, wherein said insertion receptacle extends between the two rounded element portions by way of its longer axis and between the two receptacles by way of its shorter axis. This configuration enables an extremely compact, small-format configuration of the coupling element. This is because this alignment of the rectangular insertion receptacle makes it possible to draw the two virtually V-shaped receptacles of the coupling element relatively far into the cylindrical base portion. They end just before the insertion receptacle, thereby, as already described, ultimately leading to the coupling-element-side element projections being able to have a short configuration.

The coupling element itself may be made of plastic, that is to say a plastics component which is produced correspondingly in an injection molding process and is made of a plastic which has the desired mechanical and physical properties, e.g. with respect to its hardness, temperature resistance and the like. As an alternative to this, the coupling element may also be made of metal, for example aluminum or steel.

As described, the screw spindle pump generally also comprises a drive motor or such a drive motor is secured thereto, which is axially fitted on the outer housing and the drive shaft of which imperatively is axially in line with the longitudinal axis of the drive spindle. This is because the drive shaft, as described, engages in the insertion receptacle of the coupling element, which also sits centrally in the longitudinal axis of the drive spindle. The functional principle of the screw spindle pump is based on the fluid being delivered axially, that is to say it leaves the spindle set axially and flows past the coupling element, which, as stated, on account of its geometry according to the invention does not reduce or negligibly reduces the flow cross section. The motor-side drive shaft usually likewise has a cylindrical cross section, and at the end of the shaft the corresponding insertion geometry, that is to say for example a likewise square or rectangular engagement pin, is formed. Since the fluid delivered leaves the spindle set axially, it flows as described past the coupling element, but also imperatively then past the drive shaft, at least in the coupling region, to the coupling element. In order then also for there not to be any obstacle to the flow in the transition between the coupling element and the drive shaft, one expedient refinement of the invention provides a drive motor, wherein the diameter of the cylindrical drive shaft of the drive motor corresponds at most to the diameter of the cylindrical spindle core. This means that it is also the case here that the diameters are matched, and therefore it is ensured that the drive spindle cross section, as seen radially, does not engage in the flow cross section of the drive spindle and, as it were, subsequently reduce it at the spindle-side outlet. This means that there is also no step or no obstacle to the flow, with respect to the spindle core diameter, in the transition region between the coupling element and the drive spindle, with the result that a virtually unobstructed axial outflow takes place. This axial outflow always takes place irrespective of whether the screw spindle pump is a dry-running rotor, in the case of which the volume delivered by the spindle set, after exiting the spindle set, thus flows directly, as it were, to a pump outlet without circulating through the drive motor to cool it, or whether the screw spindle pump is configured as a wet-running rotor, in the case of which some of the fluid delivered enters the motor housing, in order to cool components that are present there and recirculate back to the pump housing or outer housing. The diameter of the drive shaft may also be smaller than the spindle core diameter of the drive spindle, but may also correspond to the diameter of the cylindrical base portion of the coupling element.

As described, the screw spindle pump may be a 2-spindle pump, with one drive spindle and only one running spindle positioned laterally thereto. As an alternative, it may also be a 3-spindle pump, with a central drive spindle and two running spindles, which are positioned to the left and right thereof and mesh therewith.

In addition to the screw spindle itself, the invention also relates to the use of such a screw spindle pump in a motor vehicle for the purpose of delivering an operating liquid. This operating liquid may be fuel or some other fluid, such as a cooling fluid, for example for cooling a traction or drive battery, or some other useful fluid, such as a windscreen cleaning fluid or the like, for example. Such screw spindle pumps can also be used in other land vehicles or aircraft, such as e.g. airplanes or drones, the possible uses not being restricted thereto.

In particular, however, the screw spindle pump is used as a coolant pump, in particular for delivering a coolant serving to cool an energy store. This may be any desired coolant.

The various features of novelty which characterize the invention are pointed out with particularity in the claims annexed to and forming a part of the disclosure. For a better understanding of the invention, its operating advantages, specific objects attained by its use, reference should be had to the drawings and descriptive matter in which there are illustrated and described preferred embodiments of the invention.

DETAILED DESCRIPTION OF THE INVENTION

Figure 1:
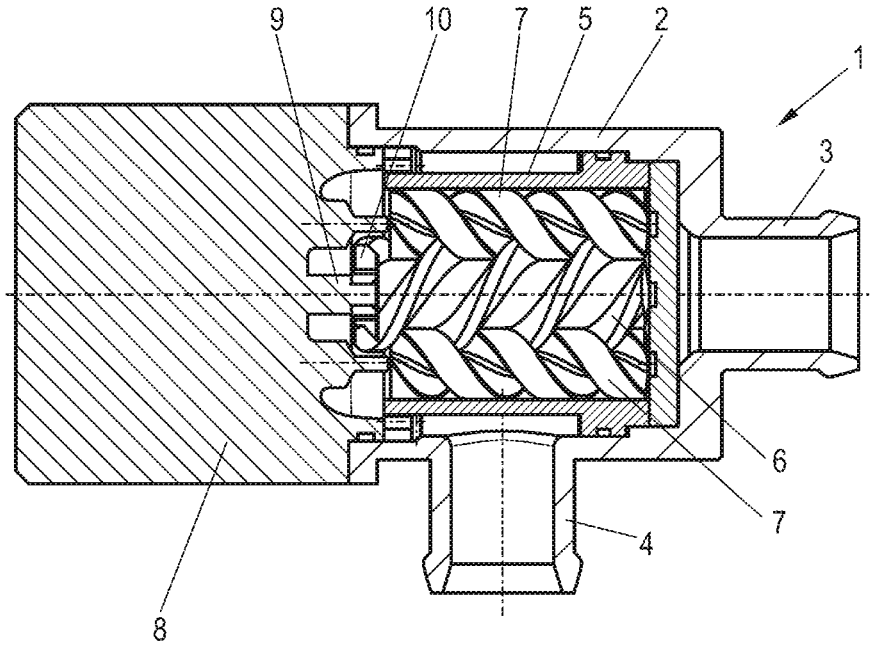
FIG. 1 shows a schematic illustration, in section, of a screw spindle pump according to the invention with one drive spindle and two running spindles.

FIG. 1 shows a screw spindle pump 1 according to the invention, comprising an outer housing 2 with an inlet port 3, which is arranged axially, and an outlet port 4, which is arranged radially. In the outer housing 2, which can also be referred to as pump housing, there is arranged a spindle housing 5, in which, in the exemplary embodiment shown, three spindles, specifically a central drive spindle 6 and two running spindles 7, arranged to either side of the drive spindle 6, are received in corresponding, intersecting spindle bores. The spindles 6, 7 each have spindle profiles which engage in one another, that is to say mesh with one another.

Furthermore, a drive motor 8, which is shown only schematically here and which may be a dry-running or wet-running drive motor, is provided. Said drive motor has a drive shaft 9, which is shown only in a stylized manner here and is connected to the drive spindle 6 for conjoint rotation therewith via a coupling element 10. This means that the drive spindle 6 is actively driven by the drive motor 8. A rotation of the drive spindle 6 imperatively also leads to a rotation of the two running spindles 7, owing to the engagement of the spindle profiles. Corresponding delivery volumes are axially moved or displaced by the mutually engaging spindle profiles and the spindle rotation, whereby the fluid delivery is effected in a known way. The fluid is axially drawn in through the inlet ports 3, is delivered along the spindle set and exits at the motor-side end of the spindle set, from where it flows to the outlet port 4 via a corresponding flow geometry.

Figure 2:
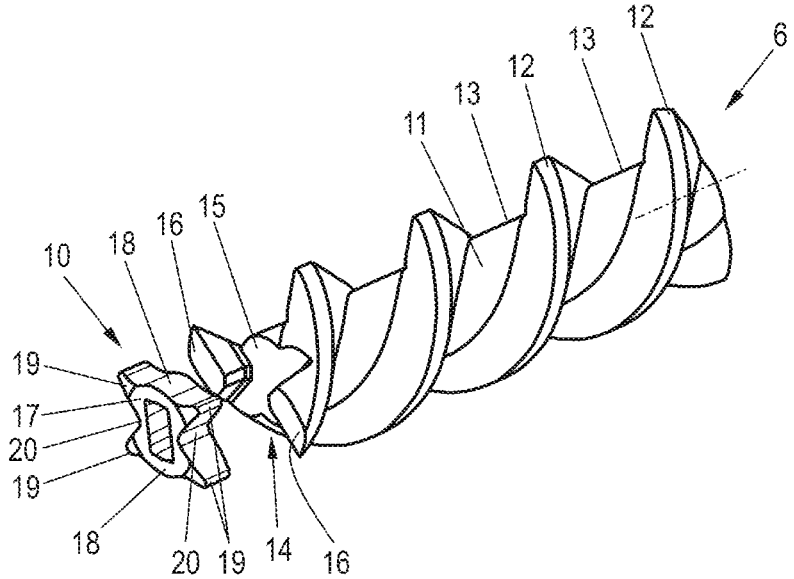
FIG. 2 shows an exploded view of the drive spindle and of the coupling element not inserted in the depression.

FIG. 2 shows the drive spindle 6 and the coupling element 10 in an enlarged, perspective view in the form of an exploded view. The drive spindle 6, made of metal or plastic, has a cross-sectionally cylindrical spindle core 11, around which run two spindle profiles 12, resulting in the formation of corresponding profile valleys 13. At an axial end, the drive spindle 6 has a depression 14, which is axially delimited by a planar bottom surface 15 and which is laterally delimited by two projections 16, wherein these two projections 16 are formed, as it were, as an extension of the spindle profiles 12 that run into the base surface 15. The projections 16 are machined by material removal, which will be discussed in more detail below in connection with FIG. 4, with the result that overall a bottom surface 15 is produced which, on the one hand, in certain portions is formed by the spindle core 11 and, on the other hand, on account of the machining of the projections 16, is formed by adjacent bottom portions, which will be discussed in more detail below.

The coupling element 10, likewise made of metal or plastic, has a disk-shaped configuration, and thus has a defined, maximum thickness. It comprises a cylindrical base portion 17, which has two opposite element regions 18 with a rounded configuration. Furthermore, in the example shown, on the base portion 17 there are provided 4 element projections 19 that protrude to the side and define a respective V-shaped receptacle 20 between them, in which receptacle the projections 16 engage in the mounted position, when the coupling element 10 is inserted in the depression 14.

Figure 3:
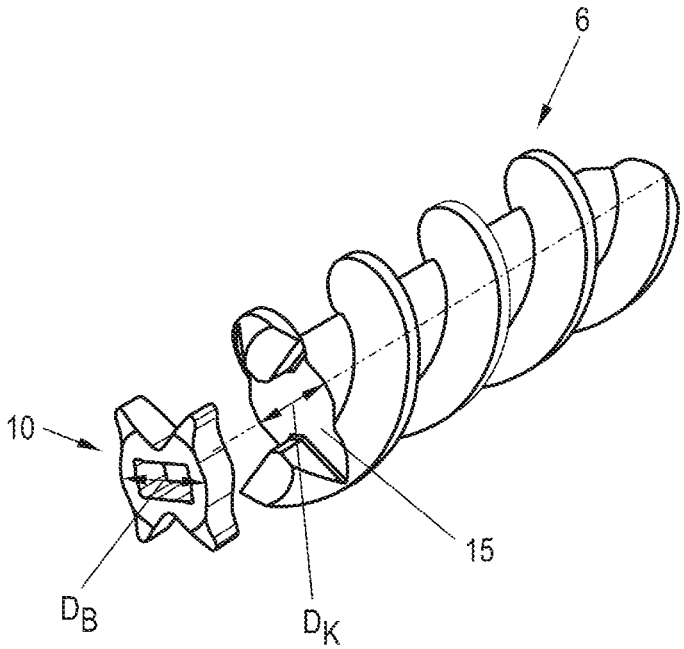
FIG. 3 shows the arrangement of FIG. 2 illustrating the relevant diameter on the spindle core and on the base portion.

As FIG. 2, but also FIG. 3 shows, the bottom surface 15 is formed and bordered at least in certain portions by the cylindrical spindle core 11. This rounded border, resulting from the cylinder shape of the spindle core 11, is provided at the opening of the respective profile valley 13, since the profile valley is defined by the spindle core 11. The spindle core 11 has a core diameter DK, which is illustrated in FIG. 3.

As described, the coupling element 10 also has a disk-shaped, cylindrical base portion 17, which has a base-portion diameter DB likewise illustrated in FIG. 3. The design of the size or geometry of the coupling element 10 is then selected in such a way that the diameter of the base portion 17 is smaller than or the same as the diameter of the spindle core, and consequently DB DK. This means that, in the mounted position, the rounded element regions 18 at which the base-portion diameter DB is provided imperatively do not protrude into the flow cross section or opening cross section of the respective profile valley 13. Consequently, the coupling element 10 does not obstruct the flow, at least in the region of the rounded element portions 18.

Figure 4:
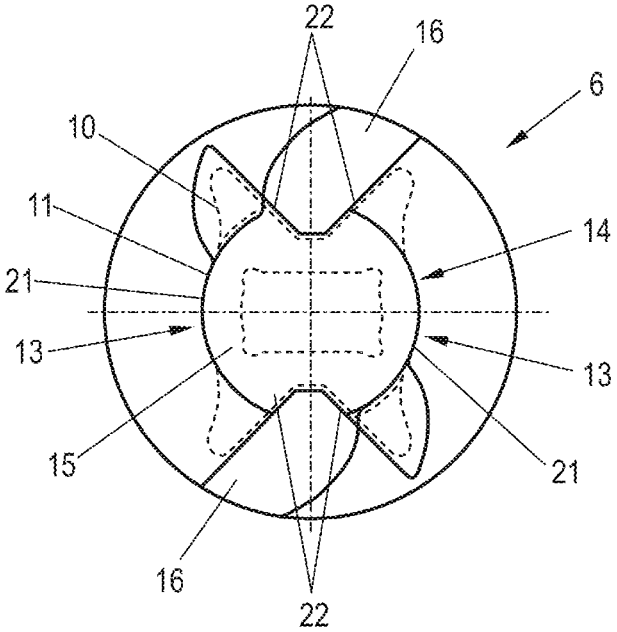
FIG. 4 shows a view of the end face of the drive spindle looking toward the depression receiving the coupling element.

FIG. 4 shows a plan view of the end face of the drive spindle 6 looking toward the depression 14. What is shown is the two profile valleys 13 that open out there and also the spindle core, which defines the rounded border of the bottom surface 15 in the mutually opposite edge portions 21.

The end face is machined via corresponding cross-grinding means, this on the one hand leading to an enlargement of the bottom surface 15 via the spindle core surface. On the other hand, this produces a specific form-fitting or engagement geometry of the projections 16, which have two V-shaped bearing surfaces 22 by way of which they bear against the entire surface area of corresponding bearing surfaces of the coupling element 10 or are positioned closely thereto, spaced apart by a narrow gap. The coupling element 10 is illustrated in dashed lines.

The formation of the cross-grinding means produces four lateral enlargement portions of the base surface 15, resulting in the production of an X-shape, as it were, as shown illustratively in FIG. 4.

Figure 5:
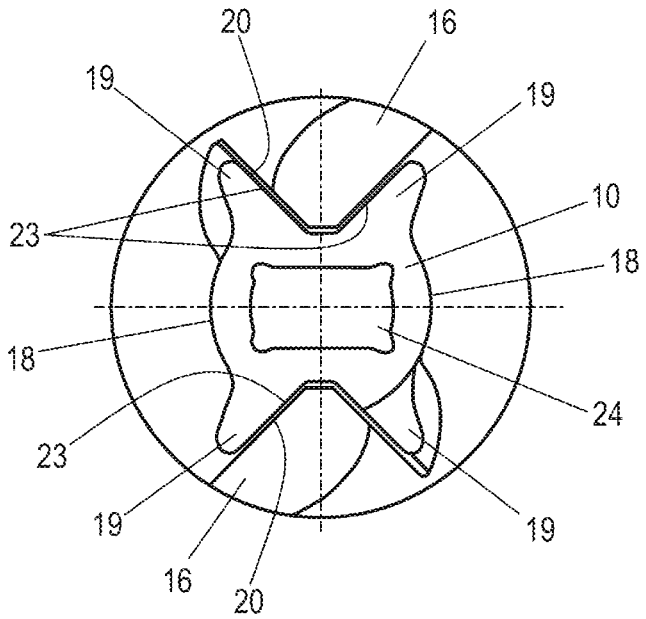
FIG. 5 shows a plan view of the arrangement of FIG. 4 with the coupling element inserted.
Figure 6:
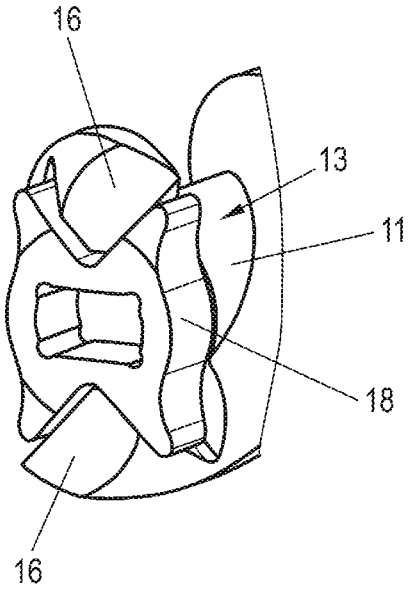
FIG. 6 shows a perspective view of the arrangement of FIG. 5.

Then, the coupling element 10 is inserted in this depression 14, and FIGS. 5 and 6 show a corresponding plan view (FIG. 5) and a perspective view (FIG. 6). Since the base-portion diameter DB corresponds at most to the core diameter DK, consequently the rounded portions 18 of the coupling element 10 do not protrude into the flow cross section defined by the spindle core 11, as shown illustratively in FIGS. 5 and 6. The element projections 19 each delimit two V-shaped, laterally open receptacles 20, which are defined by two bearing surfaces 23. The receptacles 20 extend into the base portion 17 and end just before an insertion receptacle 24, which has a square or rectangular cross section and serves to receive a correspondingly shaped engagement pin of the drive shaft 9. In the mounted position according to FIGS. 5 and 6, the receptacles 20 receive the two projections 16 in a form-fitting or shape-matched manner, as it were. Owing to the bearing of the surfaces 22, 23 and the respective V-shaped engagement, a rotationally conjoint connection is provided both in the event of clockwise and anticlockwise rotation.

The element projections 19 extend, as described, from the base portion 17, with the result that here an X-shape, as it were, corresponding to the X-like shape of the depression or the bottom surface 15 is produced. It is also the case that the element projections 19 ultimately do not protrude into the opening cross section of the respective profile valley 13 on the end face, with the result that consequently the coupling element 10 does not or virtually does not obstruct the fluid flow. Only the element projection 19 shown at the top right and at the bottom left in FIG. 5 protrudes slightly into the flow cross section, but its obstacle function is negligible.

As shown in FIGS. 5 and 6, the element projections 19 taper toward their free end, and their thickness also decreases toward their free end. Corresponding oblique surfaces or bevels are formed, indeed on both sides, with the result that reverse mounting is also possible without problems.

As shown in FIG. 5, the coupling element 10, as seen axially, lies virtually completely on the base surface 15 or axially covers it. Only the element projection 19 shown at the top right in FIG. 5 and the element projection 19 shown at the bottom left in FIG. 5 protrude somewhat radially beyond the base surface 15 into the flow cross section. This engagement or this cross-sectional covering, however, is small, and therefore the flow-obstructing effect is virtually negligible.

Figure 7:
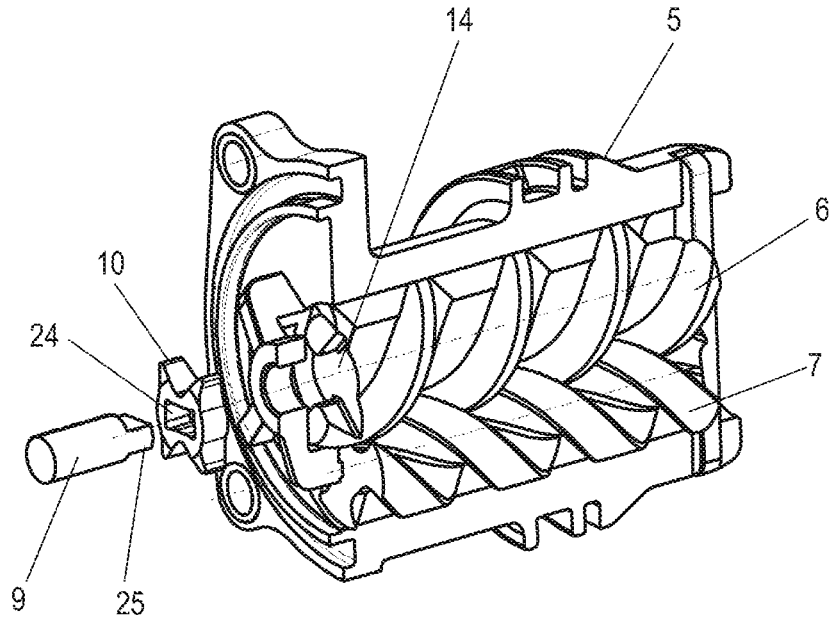
FIG. 7 shows a sectional exploded illustration of part of the screw spindle pump with a schematically illustrated drive shaft of the drive motor.

FIG. 7 shows an exploded view of the inner housing 5 of a screw spindle pump with only two spindles, specifically in turn one drive spindle 6 and only one running spindle 7, in comparison with the 3-spindle embodiment according to the preceding figures. This serves to illustrate that a coupling according to the invention can be provided both for a 3-spindle and for a 2-spindle screw spindle pump 1.

Figure 8:
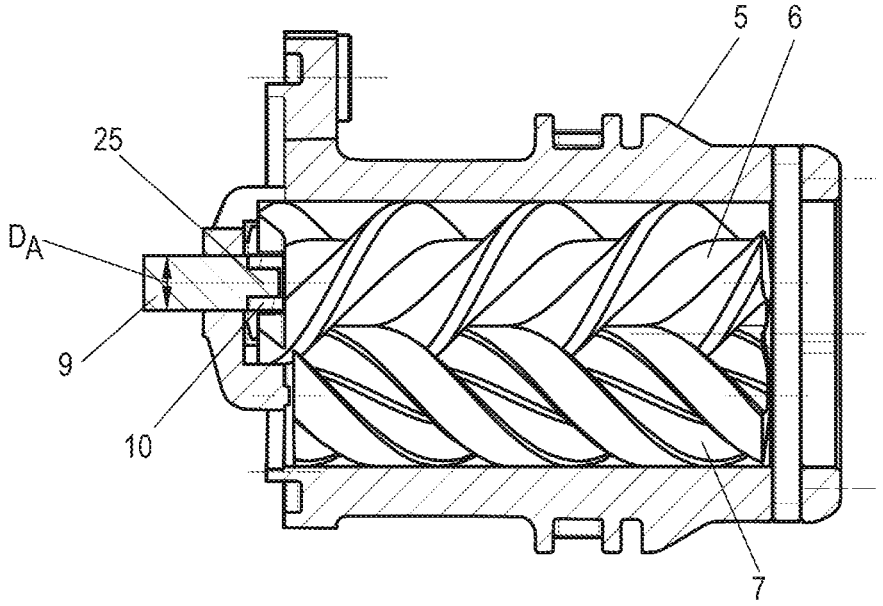
FIG. 8 shows the arrangement of FIG. 7 in the mounted state, which is shown in section.

In the exploded illustration according to FIG. 7, at the axial end of the drive spindle 6, there is formed a depression 14 with an identical configuration as described above, and an identical coupling element 10 is inserted in this depression 14. What is furthermore schematically illustrated is the drive shaft 9 of the drive motor with the end-side insertion pin 25, which engages in a form-fitting manner in the insertion receptacle 24. In the mounted position, as shown in FIG. 8, the insertion pin 25 engages in the insertion receptacle 24, while at the same time the coupling element 10 is fitted in the depression 14. A rotation of the drive shaft 9 therefore imperatively leads to a rotation of the drive shaft 6, and via the latter also of the running spindle 7, the rotations being coupled via the coupling element 10, with the result that the pump can deliver the fluid. Owing to the geometry of the projections 16 and the receptacles 20 and the respective V-shaped configuration via the corresponding bearing surfaces, a rotation of the drive shaft 9 and thus of the drive spindle 6 both clockwise, that is to say in the delivery direction, and, where required, counterclockwise is possible, since a rotationally conjoint coupling is provided in both directions of rotation.

As is also shown in FIG. 8, the diameter of the drive shaft 9, denoted by DA in FIG. 8, is smaller than the core diameter DK of the spindle core 11. The diameter DA corresponds substantially to the diameter of the base portion DB of the coupling element 10. This is shown illustratively in FIG. 8. This results, consequently, in likewise no step constituting an obstacle to the flow being formed in the transition between the coupling element 10 and the drive shaft 9, which would be the case if the diameter DA were larger than the base-portion diameter DB. This means that the fluid axially exiting the spindle set ultimately is exposed to virtually no obstacle to the flow at all, apart from the two short element projections 19 which protrude only slightly into the flow cross section, as described above. Otherwise, the fluid can flow in a completely free-flowing manner, by contrast to coupling devices known to date, as described in the introduction.

Such a screw spindle pump 1, irrespective of whether it is a pump having two spindles or three spindles, may be used to deliver a very wide variety of fluids. With preference, it is used in the motor vehicle sector, either as a fuel pump or a delivery pump for some other operating fluid, in particular for a coolant, which is used to cool an energy store of the motor vehicle. The energy store is a large-volume traction storage unit of an electric vehicle. It is thus a coolant pump. Other intended uses are of course equally conceivable, for example as a delivery pump for a washing fluid, which is used for washing the windscreen of the vehicle or similar purposes.

While specific embodiments of the invention have been shown and described in detail to illustrate the inventive principles, it will be understood that the invention may be embodied otherwise without departing from such principles.

We claim:

1. A screw spindle pump, comprising a spindle housing, in which a drive spindle and at least one running spindle meshing therewith are received in spindle bores, wherein the drive spindle has a cylindrical spindle core and at least two spindle profiles around the circumference of the spindle core, and, on an end face of the drive spindle, in a depression which is axially delimited by a planar bottom surface and in which the two profile valleys open out between the two spindle profiles in a manner offset by 180°, there is arranged a disk-shaped coupling element, which has an insertion receptacle for a drive shaft of a drive motor and which is coupled to the drive spindle for conjoint rotation therewith in at least one direction of rotation of the drive spindle via a form-fitting engagement with axially protruding projections that laterally delimit the depression and engage in lateral receptacles of the coupling element, wherein the bottom surface is delimited by the spindle core in the region of the openings of the two profile valleys, and the coupling element has a rounded configuration, corresponding to the shape of the spindle core, in the element regions that adjoin the regions of the opening, wherein the diameter of the coupling element, in the region of the rounded element regions, corresponds at most to the diameter of the spindle core or is smaller than the diameter of the spindle core.

2. The screw spindle pump according to claim 1, wherein the coupling element has a cylindrical base portion from which four element projections protrude, wherein two adjacent element projections delimit a lateral receptacle.

3. The screw spindle pump according to claim 2, wherein the receptacle extends into the base portion.

4. The screw spindle pump according to claim 2, wherein the element projections are triangular and taper toward their free end.

5. The screw spindle pump according to claim 2, wherein the thickness of each element projection decreases toward its free end.

6. The screw spindle pump according to claim 2, wherein the insertion receptacle has a square shape.

7. The screw spindle pump according to claim 6, wherein the insertion receptacle has a rectangular shape, wherein said insertion receptacle extends between the two rounded element portions by way of its longer axis and between the two receptacles by way of its shorter axis.

8. The screw spindle pump according to claim 1, wherein the coupling element is made of plastic or metal.

9. The screw spindle pump according to claim 1, comprising the drive motor, wherein the diameter of the cylindrical drive shaft of the drive motor corresponds at most to the diameter of the cylindrical spindle core.

10. The screw spindle pump according to claim 1, wherein a central drive spindle and two running spindles arranged on either side of the drive spindle are provided.

11. A method for delivering an operating liquid in a motor vehicle, comprising delivering the operating liquid using a screw spindle pump according to claim 1.

12. The method according to claim 11, including using the screw spindle pump as a coolant pump for delivering a coolant serving to cool an energy store.

* * * * *